US007114932B1

(12) United States Patent
Bassine

(10) Patent No.: US 7,114,932 B1
(45) **Date of Patent: *Oct. 3, 2006**

(54) VALVE-FREE OXYGEN CONCENTRATOR FEATURING REVERSIBLE COMPRESSORS

(76) Inventor: Stuart Bassine, 141 Twin Spring Rd., Hendersonville, NC (US) 28792

( * ) Notice: Subject to any disclaimer, the term of this patent is extended or adjusted under 35 U.S.C. 154(b) by 225 days.

This patent is subject to a terminal disclaimer.

(21) Appl. No.: 10/762,687

(22) Filed: Jan. 22, 2004

(51) Int. Cl.
*F04C 18/00* (2006.01)
*F03C 2/00* (2006.01)

(52) U.S. Cl. ..... 418/268; 418/266; 418/267; 417/313; 417/326; 417/410.3; 95/96; 95/128; 95/130; 96/121; 96/124

(58) Field of Classification Search ..... 418/266–268; 417/331, 326, 410.3; 95/96–98, 128, 130; 96/121, 130, 143, 144, 124
See application file for complete search history.

(56) References Cited

U.S. PATENT DOCUMENTS 156,814 A * 11/1874 Peck ..... 418/268
3,807,644 A * 4/1974 Van Ee ..... 241/46.08
4,222,750 A * 9/1980 Gauthier et al. ..... 95/130
5,114,441 A * 5/1992 Kanner et al. ..... 95/130
5,188,524 A * 2/1993 Bassine ..... 418/268
5,474,595 A * 12/1995 McCombs ..... 96/130
5,871,565 A * 2/1999 Leavitt ..... 95/100
5,968,236 A * 10/1999 Bassine ..... 96/130
6,371,745 B1 * 4/2002 Bassine ..... 418/268
6,749,405 B1 * 6/2004 Bassine ..... 418/268

FOREIGN PATENT DOCUMENTS

JP 60060201 A * 4/1985

* cited by examiner

*Primary Examiner*—Theresa Trieu
(74) *Attorney, Agent, or Firm*—William E. Noonan

(57) ABSTRACT

A pivoting vane rotary compressor includes a housing having a generally pear-shaped chamber. A rotor mounted within the chamber defines a main and constricted chamber regions. Reversible intake and exhaust ports alternately introduce air into and exhaust air from the chamber. The rotor carries pivotable vanes and a motor drives the rotor alternately in opposing first and second directions to open the vanes and define compartments that transmit the air through the chamber between the ports. Air introduced through one of the ports is compressed and discharged through the other port. A concentrator employs a pair of these compressors as well as associated filters and crossover valves.

18 Claims, 7 Drawing Sheets

VALVE-FREE OXYGEN CONCENTRATOR FEATURING REVERSIBLE COMPRESSORS

FIELD OF THE INVENTION

This invention relates to a pivoting vane rotary compressor having a generally pear-shaped compression chamber. The invention further relates to a valve-free oxygen concentrator using the compressor.

BACKGROUND OF THE INVENTION

Conventional oxygen concentrators often employ a rotary compressor to pump air through the concentrator and to the patient. Traditionally, the compressor employed sliding carbon vanes. Such compressors do not exhibit optimal air displacement and oxygen production for the reasons discussed in my issued U.S. Pat. Nos. 5,188,524, 5,968,236, 6,371,745 B1 and pending application Ser. No. 10/132,627 filed Apr. 16, 2002. As described in the foregoing references, I have provided a reversible pivoting vane rotary compressor and a valve-free oxygen concentrator, which provide for significantly improved air displacement and concentrated oxygen production. Nonetheless, a need continues to exist for even greater air displacement, more efficient oxygen production and improved compressor and concentrator operation that is consistent, well balanced and uninterrupted. The need also exists for quieter operation of these products.

In prior pivoting vane compressors, the vane tend to exhibit premature wear as a result of rubbing against the side walls of the compression chamber. Such rubbing also tends to generate excessive heat.

SUMMARY OF THE INVENTION

It is therefore an object of this invention to provide an improved pivoting vane rotary compressor that is designed for various uses including pumps, vacuums and oxygen concentrators.

It is a further object of this invention to provide reversible pivoting vane rotary compressors which generate a consistent, balanced and interrupted air flow to the nitrogen filters of an oxygen concentrator so that a consistent high level of concentrated oxygen is produced over a given time.

It is a further object of this invention to provide a reversible pivoting vane rotary compressor that is capable of reversing direction instantaneously and operating in a balanced uninterrupted manner in both compression and vacuum drawing modes.

It is a further object of this invention to provide a reversible pivoting vane rotary compressor wherein each compressor port alternates as an inlet port and as an exhaust port depending upon the direction of the compressor's rotation so that an efficient, balanced operation is achieved.

It is a further object of this invention to provide a pair of reversible pivoting vane rotary compressors in an oxygen concentrator, which employ equivalent, complementary internal constructions and port structures so that a consistent, well balanced and uninterrupted compressor and concentrator operation is exhibited.

It is a further object of this invention to provide a reversible pivoting vane compressor that achieves air displacement that is significantly improved over known compressor designs so that increased oxygen production is achieved.

It is a further object of this invention to provide an oxygen concentrator employing a crossover valve construction which enable higher concentrations of oxygen to be obtained.

It is a further object of this invention to provide an oxygen concentrator employing a pivoting vane compressor that shields the vanes from rubbing against the sides of the compression chamber so that extended vane life and reduced heat generation are achieved.

It is a further object of this invention to provide an oxygen concentrator that facilitates adjustment of the speed of gas exchange and/or the concentration of oxygen produced.

This invention features a pivoting vane compressor including a housing having a preferably pear-shaped chamber defined by an inner wall. A rotor is mounted within the chamber to define about the rotor a compression chamber, which narrows from a main chamber region to a constricted chamber region. The rotor has a circumferential surface. There are a pair of reversible intake and exhaust ports connected communicably with the chamber proximate respective positions wherein the main chamber region and the constricted chamber region intersect. There is at least one adjoining pair of curved vanes pivotably attached to the rotor and extending in generally opposite arcuate directions from the rotor into the chamber. A motor rotatably drives the rotor alternately in opposing first and second directions such that both of the adjoining vanes are urged simultaneously against the inner wall of the chamber to define at least one compartment that transmits air through the chamber between the ports and through the main chamber region. As a result, air introduced through a selected one of the ports is compressed and discharged through the other port.

In a preferred embodiment, circumferential surface of the rotor and each vane have substantially conforming curvatures. The rotor is positioned within the chamber such that each vane is driven into substantially flush interengagement with the circumferential surface when the vane is driven by the rotor into the constricted chamber region. At least one pair of vanes may extend outwardly from the rotor in a convergent manner. At least one pair of vanes may extend outwardly from the rotor in a divergent manner. The ports may be oriented about the chamber at equal and opposite radial angles relative to the widest portion of the main chamber region. Preferably, as a pair of vanes is driven from the constricted region to the main region through the position at which the regions intersect, the compartment defined by those vanes gradually expands to draw a vacuum therein. This vacuum causes an increased volume of air to be drawn into the compartment through the port located proximate thereto.

This invention also features an oxygen concentrator employing one or more reversible pivoting vane rotary compressors. Each compressor may be constructed as previously described. In addition, a pair of nitrogen filters may be connected respectively to the ports of the compressor. The beds may have identical or dissimilar diameters. A reversible motor may be provided for rotatably driving the rotor of the compressor alternatively in opposing first and second directions such that both vanes of an adjoining pair of vanes are urged simultaneously against the inner walls of the chamber to define at least one compartment that transmits the air through the chamber between the intake and exhaust ports and through the main chamber region. As a result, when the rotor is driven in a first forward direction, air is pumped into and through the nitrogen filters to extract nitrogen from the air pumped therethrough and produce concentrated oxygen. When the rotor is driven in the opposite direction, the extracted nitrogen is exhausted from the filters by the compressor. Crossover valves may be provided to enhance the purging of nitrogen from the filters. This improves the delivery of concentrated oxygen by the system.

A protective shield may be mounted on each side of the rotor. The shield extends diametrically beyond the circumferential surface of the rotor and protects the side of the pivoting vanes from rubbing against the side walls.

The invention also relates to the use of a compressor featuring the pear-shaped combination chamber and/or protective vane shield in a non-reversing environment, i.e. such as a pump, vacuum, etc.

DETAILED DESCRIPTION OF PREFERRED EMBODIMENTS

Other objects, features and advantages will occur from the following description of a preferred embodiment and the accompanying drawings, in which.

Figure 1:
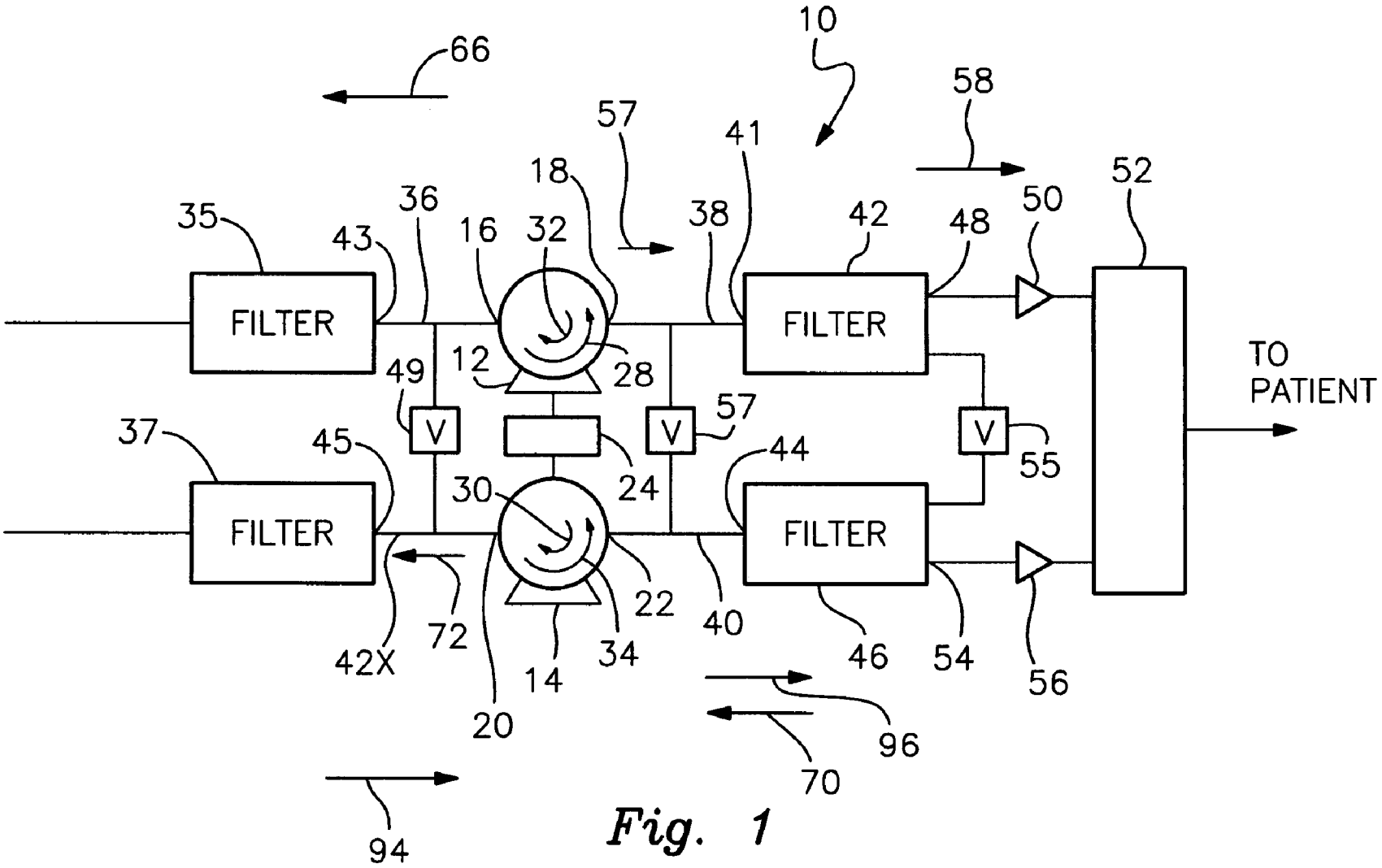
FIG. 1 is a schematic view of a preferred valve-free oxygen concentrator according to this invention, which includes a pair of rotary compressors constructed in accordance with this invention.
Figure 2:
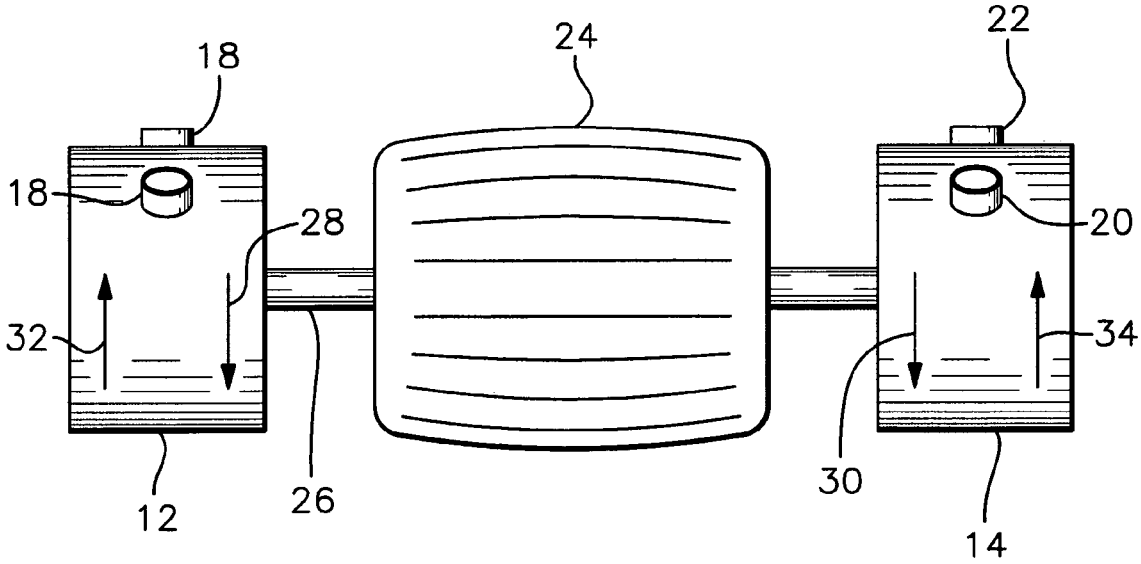
FIG. 2 is an elevational view of the reversible motor and interconnected rotary compressors used in the concentrator.

There is shown in FIG. 1 a valve-free oxygen concentrator 10 that employs a pair of rotary compressors or pumps 12 and 14. Compressors 12 and 14 are described in greater detail below. In general, each compressor includes an internal rotor mounted within a pear-shaped chamber and carrying a plurality of pivoting vanes that compress air as the rotor turns within the chamber. Compressor 12 includes a pair of ports 16 and 18 through which air is introduced and discharged from the compressor in an alternating fashion described more fully below. Similarly, compressor 14 includes a pair of ports 20 and 22 for introducing air into and discharging air from compressor 14. The compressors are structurally equivalent; port 16 corresponds to port 20 and port 18 corresponds to port 22. Each of the compressors 12 and 14 is operably connected to and driven by a reversible, brushless motor 24. This comprises a standard twin head motor of the type that will be known to persons skilled in the art. As shown in FIG. 2, motor 24 includes an axial drive shaft 26 that is connected in a known manner to the axial rotor shafts of compressors 12 and 14, respectively. The motor sequentially reverses, either periodically at predetermined intervals or when predetermined gas pressures are achieved. Specially, when the motor operates in one direction, shaft 26 drives compressor 12 rotatably in the direction of arrow 28 (hereinafter the forward direction), shown in FIG. 1. Simultaneously, the drive shaft operates compressor 14 in the direction of arrow 30 (hereinafter the reverse direction). When motor 24 reverses, compressor 12 is driven in the reverse direction indicated by arrow 32 in FIG. 1 and compressor 14 is driven in the forward direction indicated by arrow 34.

Port 16 of compressor 12 is communicably connected to a nitrogen filter bed 35 and a second port 18 of compressor 12 is likewise connected to a second nitrogen filter bed 42. By the same token, port 20 of compressor 14 is communicably connected to a nitrogen filter 37 and port 22 is similarly connected to a filter 46.

When the rotor of compressor 12 is turned in the direction of arrow 28, air is drawn into the compressor through filter 35, line 36 and port 16. That air is compressed and pumped out of compressor 12 through port 18 and line 38. Alternatively, when the motor 24 drives the rotor of compressor 12 in the direction of arrow 32, air is drawn into the compressor through line 38 and port 18 and exhausted from the compressor through port 16, line 36 in filter 35. Compressor 14 operates in an analogous manner. When motor 24 turns the rotor of compressor 14 in the direction of arrow 30, the compressor draws in air from filter 46 through line 40 and port 22. Such air is discharged through port 20 and a line 42 to filter 37. Alternatively, when the motor drives compressor 14 in the opposite direction (arrow 34) air is drawn into the compressor through filter 37, line 42 and port 20. That air is compressed and pumped out of compressor 14 through port 22 and line 40. The compressed air is directed to filter 46.

Lines 36 and 38 comprise respective conduits that communicably interconnect compressor ports 16 and 18 with ports 43 and 41 of filters 35 and 42. The nitrogen filters are standard molecular sieve beds of the type commonly used in oxygen concentrators. Similarly, lines 42 and 40 comprise conduits that communicably interconnect ports 20 and 22 of compressor 14 with ports 45 and 44 of filters 37 and 46, respectively.

Conventional means operably interconnect filters 42 and 46 to a patient or other destination requiring concentrated oxygen. In particular, an outlet port 48 of filter 42 is connected through a one-way needle valve or check valve 50 to a standard oxygen concentrator mixing tank 52. Likewise, outlet 54 of filter 46 is connected through a one-way needle valve or check valve 56 to mixer 52. The output of the mixing tank is directed through a conventional regulator and/or flow meter assembly (not shown) to, for example, a patient needling concentrated oxygen.

In this version of the concentrator, crossover valves are utilized to enhance the production of concentrated oxygen. In particular, a first crossover valve 55 is interconnected between filters 42 and 46. A second crossover valve 57 is likewise interconnected between lines 38 and 40. A third valve 49 is interconnected between lines 36 and 42*x*. The operation of these valves is explained more fully below.

Figure 3:
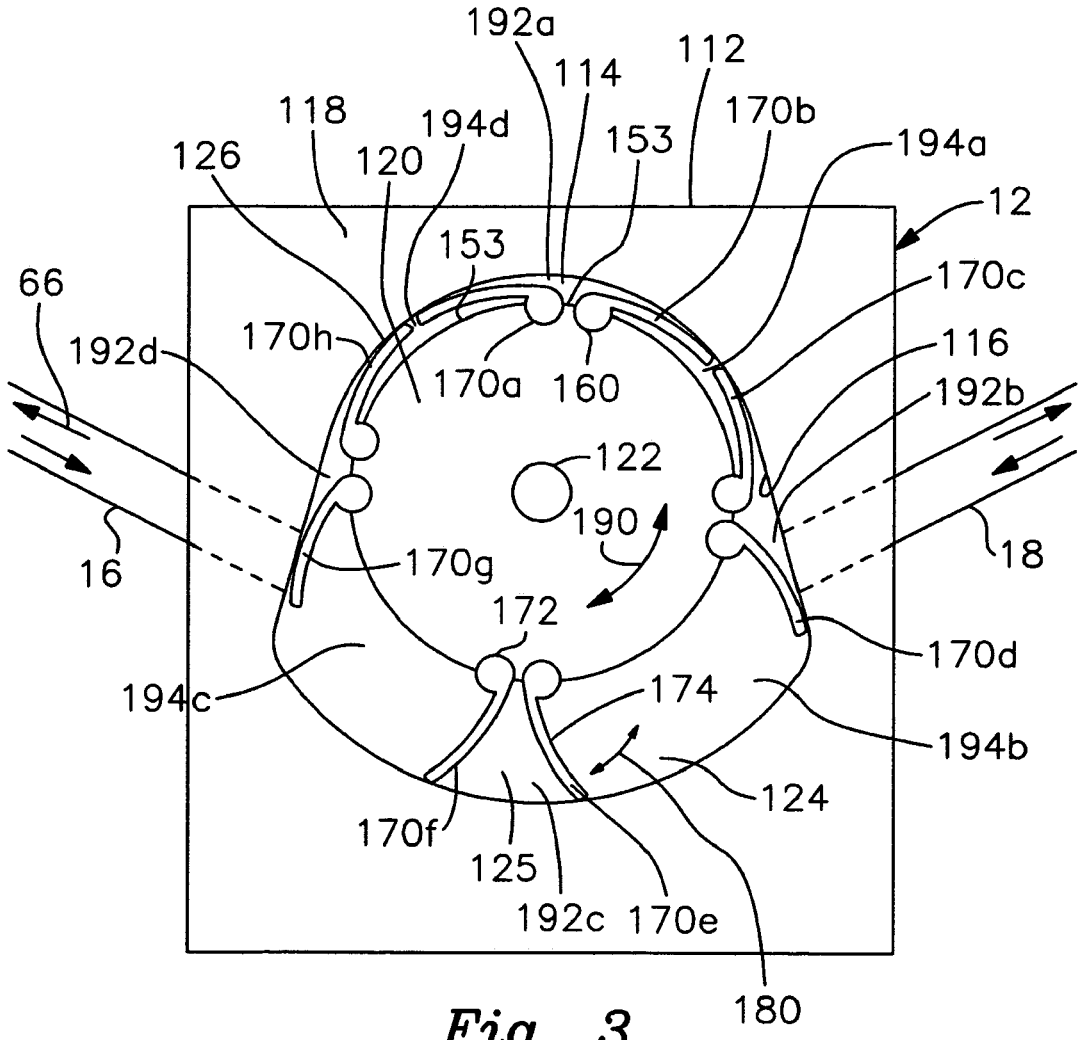
FIG. 3 is an elevational, partly cut away view of a preferred embodiment of the compressor of this invention.

There is shown in FIG. 3 a preferred representative pivoting vane compressor 12. Compressor 12 includes a housing 112 that features a generally pear-shaped inner chamber 114. As used herein, "pear-shaped" indicates that the compression chamber has a narrow end that gradually widens to a more voluminous end. The chamber is defined by a peripheral, pear-shaped wall 116 composed of Teflon™ or a similar low-friction material. The other compressor in the concentrator (i.e. compressor 14) is constructed in an analogous manner and operates alternatively with compressor 12. The following description should be understood to apply to each of the compressors in oxygen concentrator 10.

In FIG. 3, the intake/exhaust ports 16, 18 are shown communicably connected to chamber 114 through the housing 112 and inner wall 116 of chamber 114. These ports are depicted schematically and the particular construction of the ports will be known to persons skilled in the art. It should be understood that the ports may have a configuration as shown in any of the embodiments described in co-pending application Ser. No. 10/123,627. The ports may be formed through the circumferential wall or through one of the side walls of the chamber.

Housing 112 is typically defined by an outer casing 118 and a pair of opposing plates or walls 124 (one of which is shown) that engage casing 118 and enclose chamber 114. Once again, the construction of the housing and compression chamber may generally resemble the apparatus depicted in FIG. 4 of pending application Ser. No. 10/123,627. The structure employed in U.S. Pat. No. 5,188,524 may also be utilized.

A cylindrical rotor 120 is mounted within chamber 114. More particularly, rotor 120 is fixedly mounted on an axial shaft 122 that extends through chamber 114 and is itself rotatably mounted through walls 124. Rotor 120 is surrounded by a relatively wide region 125 that is defined by the bottom or wide portion of pear-shaped chamber 114. Main region 125 gradually narrows to a constricted chamber region 126. Intake/exhaust ports 16 and 18 communicate with chamber 114. More particularly, the ports communicate with the chamber proximate respective positions where constricted chamber region 126 intersects or transforms to main chamber region 125. This position is adjacent or proximate to the widest portion of pear-shaped chamber 114. The ports are themselves communicably connected to respective conduits in the manner shown in FIG. 1.

More particularly, ports 16 and 18 are preferably communicably connected to the compression chamber at equal and opposite radial angles relative to the widest part of main chamber region 125. The ports are therefore oriented symmetrically about the chamber relative to both the main chamber region and the constricted chamber region. The ports are communicably connected to the chamber by conventional air lines comprising known types of pipes, hoses or tubing. Alternative port orientations may be employed within the scope of the invention. A third port may be positioned mid-way between the ports described herein.

Rotor includes eight or some other plurality (e.g. 6, 10 or more) of axially longitudinal channels 160 formed about its circumferential surface 153. Each channel has a generally circular cross sectional shape and an entrance that is formed in the circumferential surface of the rotor. The interior of each channel includes a diameter that is larger than the entrance to the channel. This permits respective vane elements to be pivotally mounted within the channels, as is described more fully below. The channels 160 are typically arranged in adjoining pairs spaced evenly about the circumference of rotor 120, although in alternative embodiments, uneven spacing arrangements may be utilized.

A plurality of vane elements 170*a–h*, which are composed of a heat wear and heat resistant material such as Teflon™ are pivotally received respectively in rotor channels 160. The vanes may comprise Teflon™, ceramic, a Teflon™ coated material or other friction-resistant substance. Each vane element includes a generally cylindrical pin or pivot shaft 172 that is axially aligned with and received by respective rotor channel 160. Each vane element also includes an elongate curved or arcuate portion 174 that extends integrally from shaft 172.

Each vane element 170*a–h* is mounted to rotor 120 by inserting its shaft 172 into a respective one of the longitudinal rotor channels 160. Shaft 172 may be inserted into the channel, for example, by removing the cover, side plate or side wall of the housing. The shaft is then slid into its respective channel in the rotor. When inserted in this manner, each vane has a width generally equal to the width or thickness of rotor 120. Typically, shaft 172 has a diameter that is somewhat larger than the entrance of its associated rotor channel 160. As a result, the vane element is secured generally radially to the circumferential surface 153 of the rotor. At the same time, shaft 172 is pivotable within that channel. Each vane is permitted to pivot or rock relative to rotor 120, as indicated by double headed arrow 180 in FIG. 3.

Rotor 120 has a substantially smooth circumferential surface 153. Multiple pairs of vanes 172 are pivotably mounted in circumferential surface 153. The proximately adjoining pairs of vanes (170*a* and *b*, 170*c* and *d*, 170*e* and *f* and 170*g* and *h*) include curved portions that diverge from one another outwardly from the circumferential surface 153. Conversely, each distally adjoining pair of vanes (170*b* and *c*, 170*d* and *e*, 170*f* and *g*, and 170*h* and a) converges as the vanes extend outwardly from the rotor. The vanes have a generally uniform thickness, although the outer end or tip of each vane may be somewhat thicker than the inner end or neck proximate the pivoting shaft. The vanes are curved so that they substantially flushly conform with the outer circumferential surface 153 of rotor 120, at least as they travel through constricted region 126. This is best illustrated by vanes 170*a* and *b* traveling through constricted region 126 in FIG. 3.

In operation, motor 24 drives rotor 120 sequentially in alternating counterclockwise and clockwise directions, as indicated by double headed arrows 190. Centrifugal force causes vanes 170*a–h* to pivot outwardly to the greatest extent possible and engage the peripheral wall 116 of chamber 114. Each proximally adjoining, diverging pair of vanes 170*a* and *b*, 170*c* and *d*, 170*e* and *f* and 170*g* and *h* thereby defines a respective compartment 192*a*, 192*b*, 192*c* and 192*d*. Differently shaped compartments 194*a*, 194*b*, 194*c* and 194*d* are formed between respective pairs of distally adjoining vane elements (170*b* and *c*, 170*d* and *e*, 170*f* and *g*, and 170*h* and a) that converge toward one another. More particularly, each compartment is defined by the proximally or distally adjoining pair of vane elements, the circumferential surface 153 of rotor 120 and the inner circumferential chamber wall 116.

As rotor 120 is initially driven in a clockwise direction, air is pulled through port 18 and drawing into chamber 114, via compartments 192*a*–192*d* and 194*a*–194*d*, as those compartments successively pass adjacent to port 16. For example, in FIG. 3, compartment 192*b* is shown passing port 18 in a clockwise direction. The pear-shaped compression chamber contributes greatly to the volume of air being pumped. Initially, as vane 170*d* moves from the constricted chamber region 126 to the wider main chamber region 125, the vane pivots outwardly from the rotor to engage the curved outer surface of the chamber within the main chamber region. At the same time, the other vane 170*c* in that pair remains within the constricted chamber region 126. Gradually, the volume of compartment 192*b* defined by vanes 170*c* and 170*d* expands and a vacuum is drawn within compartment 192*b*. This causes an increased volume of air to be pulled into the compartment through port 18 and pumped. This volume of air is then transmitted by the compartment 192 as the rotor travels in a clockwise direction through main chamber region 125. Eventually, as vanes 170*c* and 170*d* approach second port 16 the vanes are pivoted toward a closed condition. This constricts the space of compartment 192*b* and pressurizes the air within that compartment. This compressed air is then discharged outwardly through port 16 at a desired pressure. From there, the compressed air is delivered in the direction of arrow 66 through line 36 (FIG. 1) to nitrogen filter 35. As each of the other compartments successively passes port 16 in a counterclockwise direction, that compartment likewise transmits air from port 16 through main chamber region 125 and back to constricted chamber region 126. As a result, the air is compressed and discharged through port 16 (FIG. 3) as indicated by arrows 66.

As previously indicated, each arcuate or curved portion 174 has a shape that generally conforms to a corresponding portion of the circumferential surface of rotor 120. As a result, when each vane element is driven through constricted region 126, the arcuate portion of the vane is urged substantially flush against a circumferential surface of the rotor. An extremely compact compartment is formed. Little or no air leakage is exhibited. Improved pressurization and pumping efficiency are thereby accomplished.

At a predetermined time, motor 24 reverses operation and drives rotor 120 in an opposite, clockwise direction. As each of the above-described compartments passes port 16, air from filter 35 is drawn into the compression chamber. More particularly, the air is pulled into successive compartments 192*a–d* and 194*a–d* and transmitted through those compartments through main chamber region 125. When each successive compartment reaches port 18, the air transmitted by the compartment is discharged through that port. Compressor 12 operates alternately in forward and reverse directions (counterclockwise and clockwise directions) in the foregoing fashion so that air is alternatively pumped into and exhausted from compressor 12. At the same time, the other compressor 14 operates analogously in the opposite direction. Accordingly, as compressor 12 pumps air into nitrogen filter 42, compressor 14 exhausts air into its filter 37. When the operation reverses, the compressors pump in the opposite direction. This operation continues as required so that a balanced and consistent air flow is provided. The compressors reverse direction virtually instantaneously so that uninterrupted and balanced air flow is maintained.

The pear-shaped compression chamber contributes considerably to increased air displacement and improved production of concentrated oxygen. As each leading vane in each pair of vanes arrives at the wider main chamber region, the leading vane opens to create at least a partial vacuum, while the trailing vane is held in the constricted chamber region. This permits an increased amount of air to be delivered through the associated port before the trailing vane engages and seals that port. As this pair of vanes arrives at the next port located adjacent the intersection of the main region and constricted region, the vanes are again closed to compress the air, which is then pumped out of the other port. As a result, significantly improved positive displacement of air is achieved.

Additional features are employed in the concentrator in the manner shown in FIG. 1 which improve the efficiency and concentrated oxygen quality in accordance with this invention. In particular, preliminary filters 35 and 37 are connected to compressor ports 16 and 20, respectively, so that filtered air and concentrated oxygen are delivered preliminarily to the compressors before the compressors pump that air to nitrogen filters 42 and 46. The concentrated air quality is therefore improved significantly.

Concentrator 10 also employs crossover valves 49, 55 and 57. These valves permit a portion of the concentrated oxygen pumped by each compressor to be used to purge one of the filters on the other side of the concentrator. For example, air passing through filter 35 is normally delivered by compressor 12 to filter 42. A portion of the concentrated oxygen pumped by compressor 12 is directed through crossover valve 57 to line 40. This crossover concentrated oxygen is then pumped by compressor 14 (which is running in the direction opposite compressor 12) through filter 37. By the same token, crossover valve 55 takes a portion of the concentrated oxygen produced by filters 42 and 46 and uses that oxygen to assist in purging the other of filters 42 and 46. Essentially, this design employs the sieve beds 35 and 37 to enrich air delivered to the primary filters 42 and 46. Some of the enriched air is directed from each of beds 42 and 46 to the other bed for exhausting the bed of filtered nitrogen. Valve 49 likewise allows a small portion of oxygen drawn from one of the filters 35, 37 to be used to purge the other. In addition to more effective and efficient pumping, this design also provides for quieter compressor operation. In alternative embodiments valves may be utilized to bleed small amounts of air into the system during the vacuum phase. This helps to both flush nitrogen from the filters and reduce the vacuum.

Utilizing multiple crossover valves increases the volume of air that is pumped and results in higher exchange rates and improved oxygen production and oxygen concentration levels. In addition, by lowering the air flow in the filters 42 and 46, an increased air purity is maintained.

It should also be noted that a variety of reversible motors can be used to operate the compressor. Because the compressor vanes efficiently collect and move a greater volume of air with little leakage, a relatively low speed motor can be used. This significantly reduces the noise generated by the compressor and also reduces vane breakage and maintenance costs.

The overall operation of the oxygen concentrator utilizing compressors constructed in the foregoing manner is best depicted in FIG. 1. In operation, motor 24 is started and driven in a reversible manner. For example, initially shaft 26 is rotated to drive the rotor of compressor 12 in forward direction 28. Simultaneously, the motor drives the rotor of compressor 14 in the reverse direction 30. (See also FIG. 2.) Air, prefiltered by filter 35, is drawn into compressor 12 through line 36 and port 16 in the manner indicated by arrow 64, FIG. 1. This air is compressed and pumped out of compressor 12 through port 18 and line 38, as indicated by arrows 66. As shown by arrow 57, the compressed air is directed by line 38 into and through filter 42, wherein the air is filtered. Nitrogen is removed by filter 42 and concentrated oxygen is discharged from filter outlet 48 and transmitted through valve 50 and into mixer 52, in the manner indicated by arrow 68.

While the above described process is occurring in compressor 12 and filter 42, compressor 14 simultaneously evacuates the gas (e.g. nitrogen) previously contained in second filter 46. As the rotor of compressor 14 is driven in the reverse direction of arrow 30, at least a partial vacuum is created in filter 46. Air and any previously extracted nitrogen that are contained in filter 46 are pulled out of that filter through inlet 44 and line 40, as indicated by arrow 70, and are drawn into compressor 14 through port 22. This exhausted gas is then discharged from the compressor through port 20, line 42 and filter 37, as indicated by arrow 72. Valve 56 prevents concentrated oxygen contained in mixer 52 from being drawn back into filter 46. At this point in the operation of concentrator 10, filter 42 is pressurized to produce concentrated oxygen, whereas filter 46 includes at least a partial vacuum.

As previously indicated, motor 24 periodically and sequentially reverses direction. Such reversal may be initiated by various means. For example, a timer, not shown in FIG. 1, may cause motor 24 to reverse direction at predetermined time intervals (e.g. every 8–10 seconds). Alternatively, filters 42 and 46 may be equipped with respective pressure sensing switches that are designed to detect predetermined pressure or vacuum levels. For example, the switch may comprise a pressure sensitive switch. When a predetermined pressure level is sensed in filter 42 (due to compressed air being introduced through that filter), a signal may be sent to motor 24, which signal causes the motor to reverse direction. In an analogous manner, the switch may comprise a vacuum sensitive switch that sends a signal to motor 24, causing the motor to reverse direction when a predetermined vacuum level is sensed in filter 46. In alternative embodiments, other pressure and/or vacuum sensing switches may be provided in one or both of the filters. In still other versions, a pressure sensitive switch may be contained within mixer 52. When a predetermined pressure level is measured in the mixer, a signal is sent to motor 24, which causes the motor to reverse direction. Accordingly, the motor may be reversed either at predetermined time intervals or when predetermined pressure and/or vacuum levels are sensed within the respective filters and/or the mixer. For example, the switch may comprise a pressure sensitive switch. When a predetermined pressure level is sensed in filter 42 (due to compressed air being introduced through that filter), a signal may be sent to motor 24, which signal causes the motor to reverse direction. In an analogous manner, the switch may comprise a vacuum sensitive switch that sends a signal to motor 24, causing the motor to reverse direction when a predetermined vacuum level is sensed in filter 46. In alternative embodiments, other pressure and/or vacuum sensing switches may be provided in one or both of the filters. In still other versions, a pressure sensitive switch may be contained within mixer 52. When a predetermined pressure level is measured in the mixer, a signal is sent over lines 88 and 80 to motor 24, which causes the motor to reverse direction. Accordingly, the motor may be reversed either at predetermined time intervals or when predetermined pressure and/or vacuum levels are sensed within the respective filters and/or the mixer.

In any event, when motor 24 reverses direction, the compressor rotors are driven by shaft 26 in respective directions that are opposite to those previously described. In the example disclosed herein, the compressor of rotor 12 is driven in the reverse direction of arrow 32 and the rotor of compressor 14 is driven in the forward direction of arrow 34. This causes compressor 12 to draw a vacuum in filter 42. Air and previously extracted nitrogen remaining in filter 42 are evacuated from the filter through line 38, as indicated by arrow 66. This gas is drawn into the compressor through port 18 and is exhausted through port 16, line 36, and filter 35 in the direction of arrow 66. As during the previously described sequence, valve 50 prevents previously concentrated oxygen from being drawn out of mixer 52 and back into filter 42.

Simultaneously, compressor 14 is driven in the forward direction of arrow 34. Fresh air (prefiltered by filter 37) is drawn into that compressor through line 42*x* and port 20, as indicated by arrow 94. This air is compressed and pumped out of compressor 14 through port 22 and line 40, as indicated by arrow 96. The compressed air is introduced into previously evacuated filter 46 through inlet 44. Filter 46 is pressurized and the compressed air is filtered further. Nitrogen is extracted and concentrated oxygen is discharged through outlet 54. This oxygen is delivered through one-way valve 56 to mixer 52. Accordingly, the mixing tank receives concentrated oxygen alternately from filters 42 and 46.

Motor 24 continues operating in the second direction for either the previously described predetermined time period or until a predetermined pressure and/or vacuum has been sensed in the filters and/or mixer. At such a point, an appropriate signal is sent to motor 24, which again causes the motor to reverse direction. The motor again operates in the first direction, as previously described, and the entire sequence is repeated continuously to provide a steady supply of concentrated oxygen to mixer 24. During the first half of the cycle (while motor 24 is operated in the first direction) filter 42 removes nitrogen from the air pumped into that filter by compressor 12 to produce concentrated oxygen, while a vacuum is simultaneously drawn in filter 46. During the second half of the motor's cycle, the reverse occurs. Air is pumped by compressor 14 through filter 46 to produce concentrated oxygen and filter 42 is evacuated by compressor 12. Concentrated oxygen is directed from mixer 52 to the patient or other destination requiring such oxygen in a conventional manner.

Crossover valves 49, 55 and 57 improve the operation of the concentrator 10. As compressor 12 is operating in the forward direction, arrow 28, a portion of the pumped air previously filtered by filter 35 is directed through crossover valve 57 to second compressor 14. This compressor is contemporaneously operating in the reverse direction 30 such that a portion of the redirected, concentrated air is pumped back into filter 37. This helps to purge filter 37 of previously collected nitrogen. During the reverse operation, a portion of the air previously filtered by filter 37 is redirected by valve 57 to compressor 12, which in turn pumps this concentrated oxygen back into filter 35. As a result, filter 35 is likewise purged of previously collected nitrogen.

Crossover valve 55 provides similar benefits for filters 42 and 46. When the concentrator is operating with compressor 12 turning in the forward direction, a small portion of the concentrated oxygen product produced by filter 42 is directed through valve 55 to filter 46. This redirected oxygen helps to purge nitrogen previously collected in filter 46. During the reverse operation, concentrated oxygen product from filter 46 is directed through valve 55 to filter 42 so that similar purging is performed. Third crossover valve 49 likewise operates in an analogous manner for filters 35 and 37. In certain versions only one or two crossover valves may be employed. In still other cases, the valves may be eliminated altogether.

Concentrator 10 eliminates the standard 3-way and 4-way valves and associated timers that are conventionally required for directing compressed air to and between a plurality of molecular sieve bed filters. As a result, the complexity, weight and expense of concentrator 10 are significantly less than most standard devices. The two stage pressurization/evacuation process utilized by concentrator 10 also significantly improves the efficiency of the apparatus. Each filter is evacuated before compressed air is pumped through that filter. As a result, the incoming compressed air encounters little if any resistance. Energy efficiency is improved considerably and a smaller horsepower motor may be employed. Each time the motor reverses, the compressor utilizes the pressure or vacuum that is has created during the prior half-cycle to initiate turning of its rotor in the reverse direction. The power consumption normally required during start-up of the rotor is reduced considerably. As a result, the motor may be powered by either a standard stationary DC power source or a portable source, such as a battery or the 12-volt system of an automobile.

It should be noted that, in alternative embodiments, the compressors described above may be used in an oxygen concentrator that employs only a single compressor and associated nitrogen filter. An operation and beneficial results analogous to those described above are similarly achieved in this version. In multiple compressor versions each compressor may be driven by its own associated motor. In other words, multiple reversible motors may be employed, each for driving a respective compressor.

It is important that the compressors in the dual compressor embodiment be constructed identically and operates in a complementary alternating fashion. Specifically, the ports should be located at like orientations in both compressors. In this way, a balanced, continuous air flow is achieved. An even level of air flow passes through each nitrogen filter and as a result, a consistent level of concentrated oxygen is provided to the patient. The construction of the pivoting vane compressors permits the compressors to reverse direction instantaneously and effectively. As a result, air flow is not interrupted. Preferably, the ports are oriented at equal and opposite radial angles to the narrowest portion of the compression chamber. This again improves balance and efficiency and contributes to a very smooth uninterrupted operation. In still other versions, alternative port orientations may be employed. Alternative number of intake and exhaust ports may also be utilized.

Figure 4:
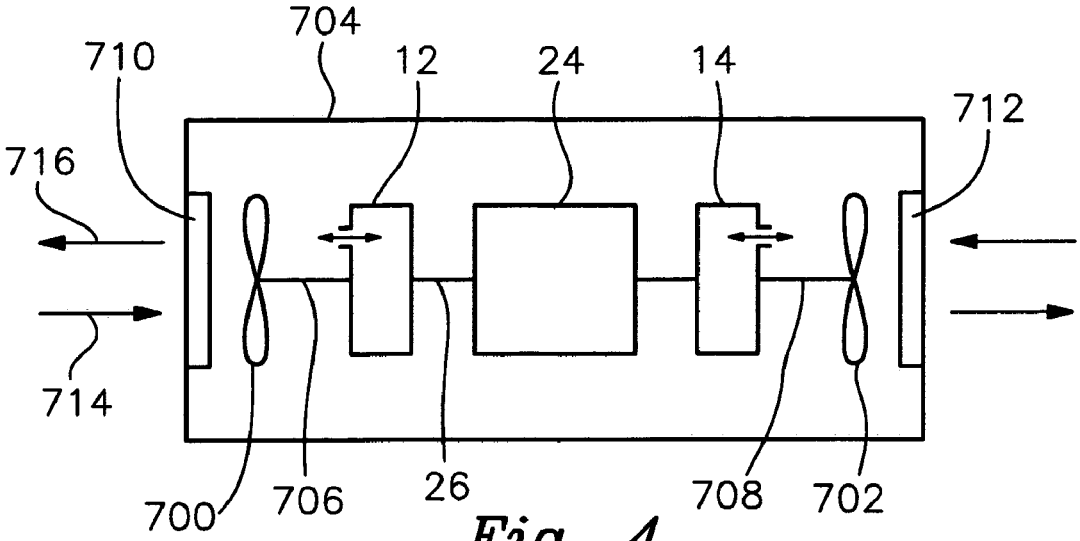
FIG. 4 is a schematic view of the reversible dual compressor assembly with reversible fans mounted within a cabinet.

An embodiment utilizing fans 700 and 702 is shown in FIG. 4. Therein, compressors 12 and 14, as well as reversible motor 24 are enclosed within a cabinet 704. The shaft 26 that drives rotors 12 and 14 carries axially driven extensions 706 and 708, which operate fans 700 and 702 respectively. Cabinet 704 includes openings at the respective ends. Each opening is covered by a respective filter 710, 712.

During operation, the reversible motor sequentially drives compressors 12 and 14 in alternating directions, as previously described. When compressor 12 is driven in a forward direction to pump air into its respective concentrator, fan 700 operates to cool motor 24 and also pulls air into the cabinet 704 through filter 710, as illustrated by arrow 714.

When motor 24 reverses, fan 700 is driven in a reverse direction so that previously collected dirt and dust is blown off of filter 710, as indicated by arrow 716. Fan 702 operates in an analogous alternating sequence. While fan 700 is cooling the motor and pulling into compressor 12, fan 702 is blowing dirt and dust from filter 712. When fan 700 is cleaning filter 710, fan 702 is pulling air into compressor 14 and cooling motor 24. Various fans may be used within the scope of this invention. Moreover, the cabinet may be modified from the version shown in FIG. 4.

Figure 5:
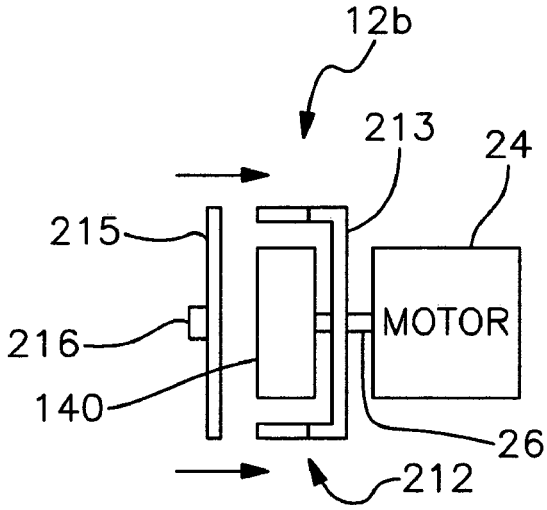
FIG. 5 is a schematic view of an alternative compressor housing.

FIG. 5 depicts a compressor 12*b* that is modified slightly from the compressor shown in FIG. 4. In this version, a two-part housing is employed. More particularly, motor 24 is attached to compressor rotor 120 through a drive shaft 26. The rotor is accommodated within a housing 212 that includes a base 213 and a cover 215. The rotor is disposed within the base and the cover is attached directly to an upper rim or edge of the base by bolts or other known means so that the rotor is enclosed within the housing. Once again, appropriate ports, e.g. port 216, are formed through the cover into the compression chamber. These ports and the remainder of the compressor are constructed and operate in a manner identical or at least analogously to the versions previously described.

Figure 6A:
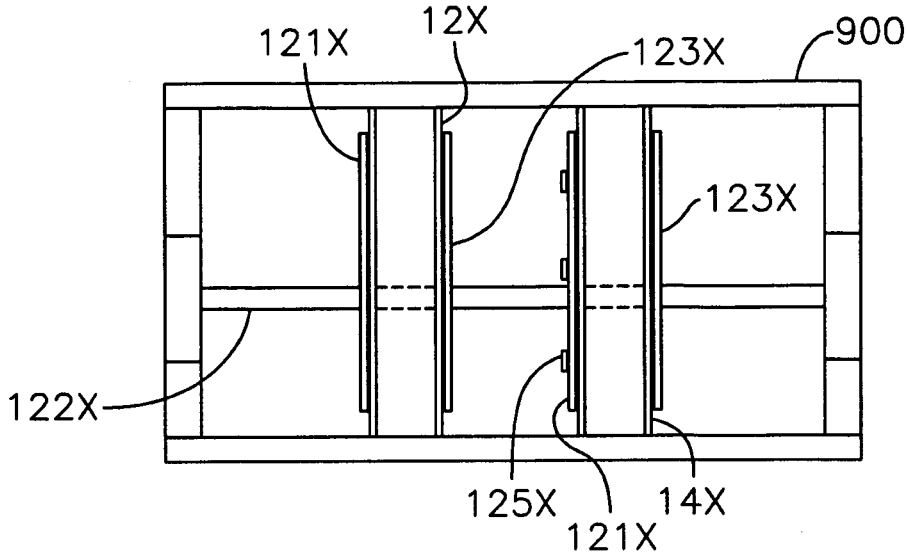
FIG. 6A is an elevational side view of a compressor assembly utilized in this invention.
Figure 6B:
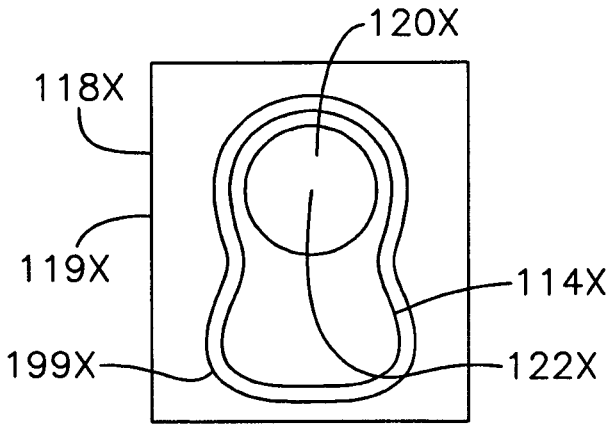
FIG. 6B is a simplified side view of a compressor with the side wall removed and the pear-shaped compression chamber exposed.
Figure 6C:
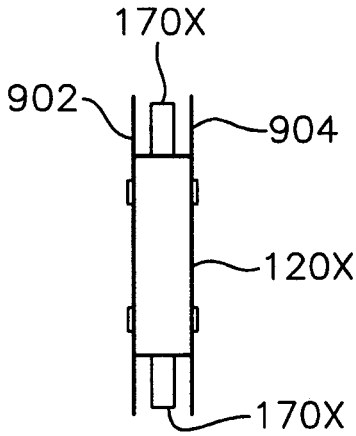
FIG. 6C is a simplified elevational view of the rotor with a vane protection shield attached.

FIGS. 6A through 6C disclose another version of the reversible pivoting vane compressor assembly wherein a pair of compressors 12*x* and 14*x* are mounted in a support structure 900. Each of the compressors, shown in side view in FIG. 6B, includes a housing 118*x* that comprises a collar 119*x* enclosed on either side by an attached wall or plate 121*x*, 123*x*. The plates are secured to the collar by screws or other appropriate attachment means 125*x*(see FIG. 6A). A seal 199*x* is mounted in the collar for interengaging the collar and the attached side wall. This provides for effective sealing of the compressor housing. A pear-shaped compression chamber 114*x* is formed within the collar. A rotor 120*x* is mounted on a axle or shaft 122*x* that extends through each of the side walls of the compressors. A motor, not shown, is operably connected to the axle 122*x*. The motor is driven to operate compressors 12*x* and 14*x* reversibly.

When pivoting vanes are mounted to the circumferential surface of rotor 120*x* in the previously described manner, certain disadvantageous results may be exhibited. In particular, the longitudinal sides of the vanes tend to rub against the interior surfaces of side walls 121*x* and 123*x*. This can cause premature and excessive wear upon the vanes, which may necessitate frequent replacement. It can also generate an undesirable level of heat in the compressor. To eliminate this problem, a pair of protective shield elements 902 and 904 are mounted to respective sides of rotor 120*x* in the manner shown in FIG. 6C. These shields are attached to the sides of the rotor by screws or other appropriate attachment means. Each shield extends diametrically outwardly beyond the circumferential edge of the rotor. As a result, the pivoting vanes 170*x* are protected and prevented from striking the side walls 121*x* and 123*x* of the compressor housing. This reduces wear on the longitudinal sides of the vanes and also reduces the level of heat in the compressor.

Figure 7A:
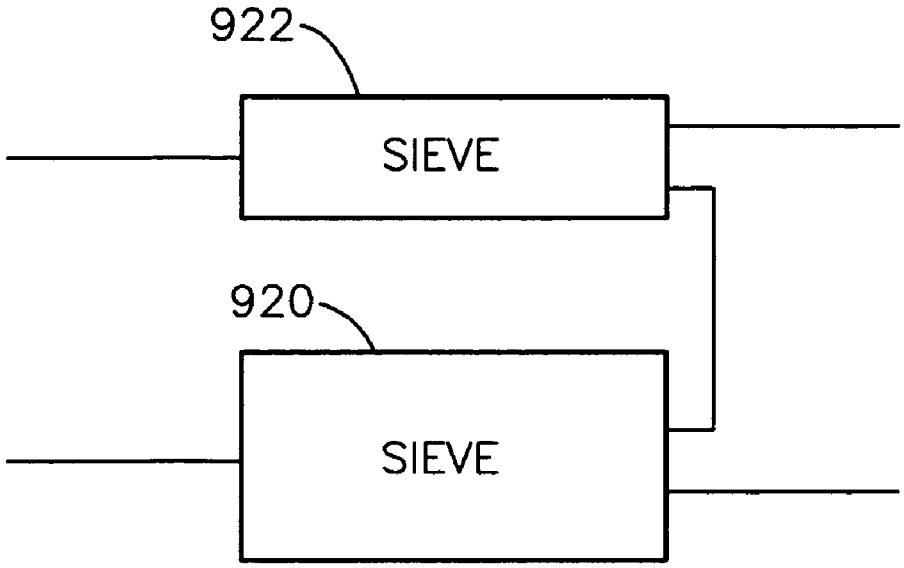
FIGS. 7A and 7B are schematic views of versions of the concentrator employing filters of differing size.
Figure 7B:
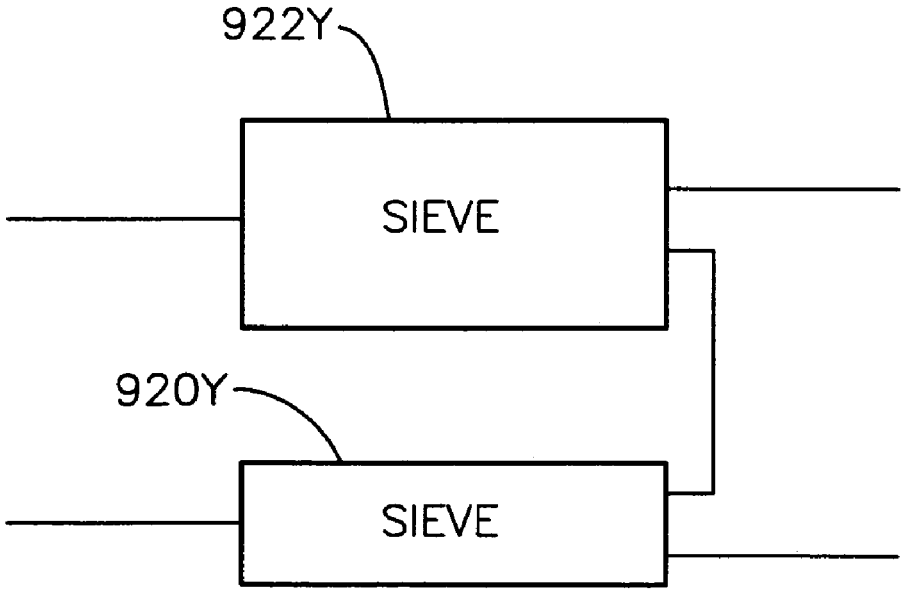

In alternative versions of the concentrator, the sieve beds or filters may have differing diameters. For example, as shown in FIGS. 7A and 7B, the filter or sieve 920 is larger than filter 922, located on the opposite side of the concentrator. Alternatively, the upper sieve filter 922*y* may be larger than the lower sieve 920*y*. See FIG. 7B. The respective filters may be varied in size so that the operator can adjust the speed of the gas flowing through the sieve beds. Any of the filters or sieve beds disclosed in this invention may be varied in this manner. In addition, each side of the concentrator may include a plurality of similarly or differently sized filter beds connected serially. An almost endless arrangement of beds and sizes of beds may be employed to provide the gas speed and oxygen concentration level required.

Figure 8:
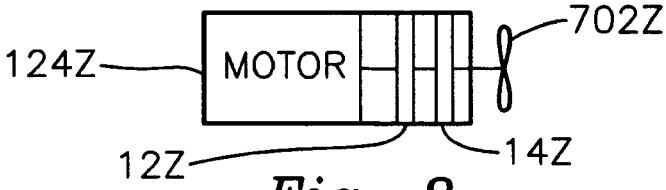
FIG. 8 is a schematic view of a compressor assembly employing two compressors mounted on the same side of the motor.

In still another version of this invention, FIG. 8, a pair of compressors 12*z* and 14*z* may be formed at one end of the compressor assembly and may be driven in the same direction by a motor 124*z*. A similar pair of side by side compressors may also be mounted on the opposite side of motor 124*z* in an analogous manner, not shown. These compressors are driven in the reverse direction simultaneously in conjunction with compressors 12*z* and 14*z*. A fan 702*z*, as previously described, may also be utilized with each side by side bank of compressors.

Figure 9:
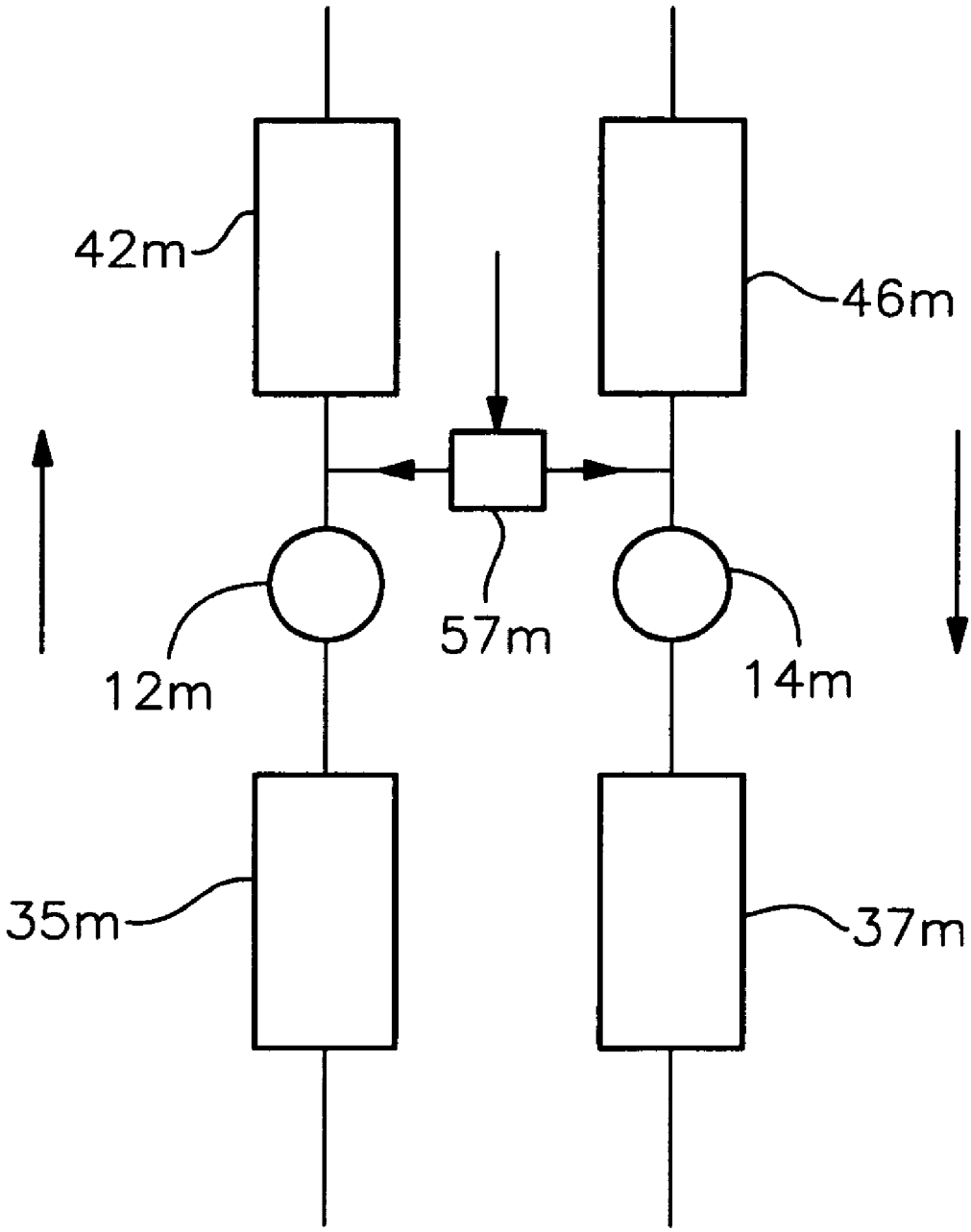
FIG. 9 is a schematic drawing of a version of the concentrator utilizing a valve for bleeding room air into the opposing sides of the concentrator so that nitrogen is flushed and the vacuum drawn is reduced.

FIG. 9 depicts a reversible concentrator utilizing filters 35*m* and 42*m* on one side of the concentrator, as well as a second pair of filters 37*m* and 46*m* on the opposite side of the apparatus. Once again, a pair of reversible compressors 12*m* and 14*m* are connected to a reversible motor (not shown) such that the compressors operate reversibly in opposing directions to one another. In this version, a valve 57*m* is utilized to allow room air to be bled into the system, for example during the vacuum phase of filter 46*m*. As compressor 14*m* draws a vacuum in filter 46*m*, air is bled into the right-hand side of the system by valve 47*m*. This air helps to flush nitrogen that has been previously collected in filter 37*m*. Introducing air into the concentrator during the vacuum phase also helps to reduce the vacuum and therefore improves the pumping efficiency of the concentrator. The same or similar valving may be utilized for the reverse, left-hand (pressure) side of the concentrator so that increased airflow is achieved through filter 42*m*. Analogous benefits are achieved when the system reverses direction.

From the foregoing it may be seen that the apparatus of this invention provides for a reversible pivoting vane rotary compressor and in particular to a compressor used in a valve-free oxygen concentrator and analogous applications. While this detailed description has set forth particularly preferred embodiments of the apparatus of this invention, numerous modifications and variations of the structure of this invention, all within the scope of the invention, will readily occur to those skilled in the art. Accordingly, it is understood that this description is illustrative only of the principles of the invention and is not limitative thereof.

Although specific features of the invention are shown in some of the drawings and not others, this is for convenience only, as each feature may be combined with any and all of the other features in accordance with this invention.

What is claimed is:

1. A pivoting vane rotary compressor comprising:

a housing having a generally pear-shaped chamber defined by an inner peripheral wall and a pair of opposing side walls on respective sides of said peripheral wall;

a rotor mounted within said chamber to define about said rotor a compression chamber, which narrows from a main chamber region to a constricted chamber region, said rotor having a circumferential surface;

at least one intake port and at least one exhaust port connected communicably with said chamber proximate respective positions wherein said main chamber region and said constricted chamber region intersect, said ports for respectively introducing gas into said chamber and exhausting gas from said chamber;

at least one adjoining pair of curved vanes pivotably attached to said rotor and extending in generally opposite arcuate directions from said rotor into said chamber; and a motor for rotatably driving said rotor such that both of said adjoining vanes are urged simultaneously against the inner wall of the chamber to define at least one compartment that transmits the gas through said chamber between said intake and exhaust ports and through said main chamber region, whereby gas introduced through a selected one of said ports is compressed and discharged through the other port; said circumferential surface of said rotor and said vane having substantially conforming curvatures and said rotor being positioned within said chamber such that each said vane is driven into substantially flush interengagement with said circumferential surface when said vane is driven by said rotor into said constricted chamber region.

2. The device of claim 1 in which said pair of ports are oriented about said chamber at equal and opposite radial angles relative to a widest portion of said main chamber region.

3. The compressor of claim 1 wherein each compartment gradually expands as the pair of vanes defining said compartment are driven from said constricted region to said main region through the position at which said regions intersect such that a vacuum is drawn in said compartment, which vacuum draws air into said compartment through the port located proximate thereto.

4. The compressor of claim 1 in which said ports comprise a pair of reversible intake and exhaust ports, each port for selectively and alternatively introducing air into said chamber while the other port exhausts air from said chamber and wherein said motor includes a reversible motor for driving said rotor alternatively in opposing first and second directions to transmit in alternating direction through said chamber and between the ports.

5. The device of claim 1 further including a shield assembly attached to and extending radially beyond the circumference of said rotor for shielding longitudinal edges of said vanes from side walls of said chamber.

6. An oxygen concentrator employing a reversible pivoting vane rotary compressor, said concentrator comprising:

a pair of nitrogen filters;

a reversible pivoting vane rotary compressor that includes a housing having an internal compression chamber defined by an inner wall, a rotor mounted within said chamber to define about said rotor a compression chamber, which narrows from a main chamber region to a constricted chamber region, said rotor having a circumferential surface, a pair of reversible intake and exhaust ports, each connected communicably and respectively with a respective filter and with said chamber proximate respective positions wherein said main chamber region and said constricted chamber region intersect, each port for selectively and alternately introducing air into said chamber while the other port exhausts air from said chamber, and at least one adjoining pair of curved vanes pivotably attached to said rotor and extending in generally opposite arcuate directions from said circumferential surface of said rotor into said chamber; and a reversible motor, for rotatably driving said rotor alternately in opposing first and second directions such that both of said adjoining pair of vanes are urged simultaneously against said inner walls of the chamber to define at least one compartment that transmits the air through said chamber between said pair of intake and exhaust ports and through said main chamber region, such that when said rotor is driven in a first forward direction, air is pumped into and through said nitrogen filters to extract nitrogen from the air pumped therethrough and produce concentrated oxygen, and when said rotor is driven in the opposite direction, said extracted nitrogen is exhausted from said filter by said compressor.

7. The device of claim 6 in which said circumferential surface of said rotor and each said vane have substantially conforming curvatures and said rotor is positioned within said chamber such that each said vane is driven into substantially flush interengagement with said circumferential surface when said vane is driven by said rotor into said constricted chamber region.

8. The device of claim 6 further including a cabinet for enclosing said compressor and said motor, said cabinet having an opening for introducing air into and removing air from said cabinet, and further comprising a filter engaged with said opening.

9. The device of claim 6 in which said filters have different sizes.

10. The device of claim 6 further including a valve for bleeding room air into at least one of said filters independently of said compressor connected thereto.

11. The device of claim 6 in which said compression chamber has a generally pear-shaped peripheral configuration including wide and narrow peripheral wall segments.

12. An oxygen concentrator comprising:

two pairs of nitrogen filters;

a first reversible pivoting vane rotary compressor that is communicably connected to said first pair of said filters and a second reversible pivoting vane rotary compressor that is communicably connected to said second pair of said filters, each compressor including a housing having an internal compression chamber defined by an inner wall, a rotor mounted within said chamber to define about said rotor a compression chamber, which narrows from a main chamber region to a constricted chamber region, said rotor having a circumferential surface, a pair of reversible intake and exhaust ports connected communicably with said chamber region proximate a respective position wherein the main chamber region and constricted chamber region intersect, each port connected to a respective filter, each port for selectively and alternately introducing air into said chamber while the other port exhausts air from said chamber, and at least one adjoining pair of curved vanes pivotably attached to said rotor and extending in generally opposite arcuate directions from said rotor into said chamber; and a motor for rotatably driving said rotors of said first and second compressors alternately in opposing first and second directions such that in each said compressor, both of said adjoining vanes are urged simultaneously against the inner wall of the chamber to define at least one compartment that transmits the air through said chamber between said pair of intake and exhaust ports and through said main chamber region such that air introduced through one of said ports is compressed and discharged through the other port; whereby said motor drives said first compressor in a forward direction to pump air into and through a first one of said first pair of filters while simultaneously driving said second compressor in a reverse direction to evacuate a first one of said second pair of filters, and alternately drives said first compressor in a reverse direction to evacuate the second filter of said first pair of filters while simultaneously driving said second compressor in a forward direction to pump air into and through the second filter of the second pair of filters.

13. The device of claim 12 in which said circumferential surface of said rotor and each said vane have substantially conforming curvatures and said rotor is positioned within said chamber such that each said vane is driven into substantially flush interengagement with said circumferential surface when said vane is driven by said rotor into said constricted chamber region.

14. The device of claim 12 in which at least two of said filters have different sizes.

15. The device of claim 12 in which said compression chamber has a generally pear-shaped peripheral configuration including wide and narrow peripheral wall segments.

16. The device of claim 12 further including at least one conduit for communicably connecting said first compressor and its connected filters to said second compressor and its connected filters and a crossover valve for selectively directing airflow through said conduit and between said compressor and their respective attached filters.

17. A pivoting vane rotary compressor comprising:

a housing having a compression chamber defined by an inner peripheral wall and a pair of opposing side walls on respective sides of said peripheral wall;

a rotor mounted within said chamber to define about said rotor a compression chamber, which narrows from a main chamber region to a constricted chamber region, said rotor having a circumferential surface;

at least one intake port and at least one exhaust port connected communicably with said chamber proximate respective positions wherein said main chamber region and said constricted chamber region intersect, said ports for respectively introducing gas into said chamber and exhausting gas from said chamber;

at least one adjoining pair of curved vanes pivotably attached to said rotor and extending in generally opposite arcuate directions from said rotor into said chamber;

a protective shield attached to and extending diametrically outwardly from said rotor on either side of each said vane for shielding said vanes from said side walls of said chamber; and a motor for rotatably driving said rotor such that both of said adjoining vanes are urged simultaneously against the inner wall of the chamber to define at least one compartment that transmits the gas through said chamber between said intake and exhaust ports and through said main chamber region, whereby gas introduced through a selected one of said ports is compressed and discharged through the other port.

18. The device of claim 17 in which said peripheral wall has a generally pear-shaped peripheral configuration including wide and narrow peripheral wall segments.

* * * * *